US012017734B2

(12) United States Patent
Jantzen et al.

(10) Patent No.: US 12,017,734 B2
(45) Date of Patent: Jun. 25, 2024

(54) WATER DIVERTING FLAT DRIFTING HULL FOR A CATAMARAN

(71) Applicant: Proglider Boats, LLC, Englewood, FL (US)

(72) Inventors: Lyon A. Jantzen, Placida, FL (US); Joseph A. Jantzen, Trenton, ME (US)

( * ) Notice: Subject to any disclaimer, the term of this patent is extended or adjusted under 35 U.S.C. 154(b) by 397 days.

(21) Appl. No.: 17/459,549

(22) Filed: Aug. 27, 2021

(65) Prior Publication Data

US 2022/0324535 A1 Oct. 13, 2022

Related U.S. Application Data

(60) Provisional application No. 63/174,261, filed on Apr. 13, 2021.

(51) Int. Cl.

| | |
|---|---|
| ***B63B 1/12*** | (2006.01) |
| ***B63B 3/48*** | (2006.01) |
| ***B63B 3/56*** | (2006.01) |
| ***B63B 17/00*** | (2006.01) |
| ***B63B 29/04*** | (2006.01) |
| ***B63B 35/38*** | (2006.01) |

(52) U.S. Cl.

CPC ..... *B63B 1/121* (2013.01); *B63B 3/48* (2013.01); *B63B 3/56* (2013.01); *B63B 17/00* (2013.01); *B63B 29/04* (2013.01); *B63B 35/38* (2013.01); *B63B 2029/043* (2013.01)

(58) Field of Classification Search

CPC .. B63B 1/00; B63B 1/121; B63B 3/00; B63B 3/48; B63B 3/56; B63B 17/00; B63B 29/00; B63B 29/04; B63B 35/00; B63B 35/38; B63B 2029/043

USPC ..... 114/61.24

See application file for complete search history.

(56) References Cited

U.S. PATENT DOCUMENTS

| | | | | |
|---|---|---|---|---|
| 7,461,612 | B1 * | 12/2008 | Houck | B63B 1/121 114/357 |
| 8,656,856 | B1 * | 2/2014 | Morrow | B63B 17/02 114/61.1 |
| 8,752,492 | B1 * | 6/2014 | Harris | B63B 32/60 114/61.1 |
| 11,046,398 | B2 * | 6/2021 | Enyart | B63B 1/121 |

* cited by examiner

*Primary Examiner* — Lars A Olson

(74) *Attorney, Agent, or Firm* — Whiteford, Taylor & Preston, LLP; Gregory M. Stone

(57) ABSTRACT

A flat catamaran watercraft construction is provided having a bow that defines a "split V" configuration in which the bottom surface of each of the two asymmetrical catamaran hull portions at the forward section of each hull portion slope upward from the inboard side of the hull portion to the outboard side of the hull portion. Such upward slope of the bottom of each hull portion sheds water and waves to the outboard sides of the vessel as it travels through the water in order to minimize the amount of water and spray that is directed upward between the individual hull portions towards the passengers. The rear portions of each such hull portion define an angled slope along both inboard and outboard sides, which angled slopes allow the rear portion of the watercraft to slide and drift sideways along the surface of the water as the watercraft turns. The flat catamaran hull portions and deck of the watercraft are preferably of unibody construction, such that they are formed (e.g., molded or otherwise machined) in a single, one-piece assembly.

26 Claims, 10 Drawing Sheets

WATER DIVERTING FLAT DRIFTING HULL FOR A CATAMARAN

CROSS REFERENCE TO RELATED APPLICATIONS

This application is based upon and claims the benefit of U.S. Provisional Application No. 63/174,261 titled "WATER DIVERTING FLAT DRIFTING HULL FOR A CATAMARAN," filed with the United States Patent & Trademark Office on Apr. 13, 2021, the specification of which is incorporated herein by reference in its entirety.

FIELD OF THE INVENTION

This invention relates generally to catamaran-styled watercraft, and more particularly to flat catamaran hulls configured for diverting water away from passengers while enabling sideways drifting of the watercraft.

BACKGROUND OF THE INVENTION

The sport of boating offers enthusiasts wide varieties of recreational options. While some enjoy the luxury of large yachts, many that would like to be out on the water do not have the financial resources to purchase such luxury yachts, and likewise often do not wish to undertake the time commitment of upkeep of a large vessel. As a result, there are many boating enthusiasts who prefer smaller watercraft, such as runabouts, flats boats, tenders or personal watercraft that may readily be trailered and obtained for far less financial investment than a yacht. Moreover, such smaller watercraft can be easier to operate, maintain, and offer a "sporty" operation that the more casual enthusiast might have interest in.

Many such watercraft employ a V-shaped bow that is particularly shaped to cut through and shed water and waves to the outboard sides of the boat as it travels through the water, thereby keeping the passengers relatively dry during operation, particularly in rougher sea conditions. However, on catamaran-style watercraft, typical V-bows, gull bows, or flat hull designs can tend to create a very wet ride for the passengers. More particularly, water and waves that impact the inboard side of the V, gull, or flat between the catamaran hulls as they travel forward through the water is first directed upward off of each inboard surface of the V, gull, or flat, and then back at the passengers sitting atop the catamaran. While such watercraft can provide a compact and portable assembly, the splashing of water on the passengers can be an annoyance that many may wish to avoid.

Moreover, as typical hull assemblies for such watercraft are intended to particularly cut through the water, the hull configurations are likewise typically shaped so as to provide a banking of the vessel during a turn and minimize a tendency of the hull to slide or plane sideways across the water to ensure adequate control of the watercraft as it is underway. While such hull configurations do succeed at offering increased banking type control, they likewise at least somewhat limit the motions of the watercraft so as avoid having the watercraft slide through a turn or curve, and thus limit the freedom of movement of the watercraft over the surface of the water.

Thus, there remains a need in the art for compact watercraft that are easy to transport and operate, that while compact will nonetheless minimize splashing and spraying of the occupants of the watercraft, and that provide for a greater freedom of movement of the watercraft over the water surface when underway so as to maximize enjoyment and excitement of the boating experience for the operator and passengers while maintaining an adequate level of comfort and safety.

SUMMARY OF THE INVENTION

Disclosed herein is a flat catamaran watercraft construction having a bow that defines a "split V" configuration in which the bottom surface of each of the two asymmetrical catamaran hulls at the forward portions of each hull slope upward from the inboard side of the hull to the outboard side of the hull. Such upward slope of the bottom of each hull sheds water and waves to the outboard sides of the vessel as it travels through the water, such that the amount of water and spray that is directed upward between the individual hulls towards the passengers is vastly reduced from that of previously known constructions. Further, the rear portions of each such hull define an angled slope along both inboard and outboard sides of the hull (between a bottom, nearly horizontal surface of each hull and the side, nearly vertical surfaces of each hull), which angled slopes allow the rear portion of the watercraft to slide and drift sideways along the surface of the water as the watercraft turns, thus adding an element of excitement to the movement of the watercraft over previously known constructions. The flat catamaran hulls and deck of the watercraft are preferably of unibody construction, such that they are formed (e.g., molded or otherwise machined) in a single, one-piece assembly both for ease of manufacture and to provide a more rigid, stable and robust assembly than previously known constructions.

In accordance with certain aspects of an embodiment of the invention, a flat catamaran hull is provided comprising first and second hull portions extending along outboard sides of the hull, each hull portion having a bottom surface having a forward end and a back end, and a forward portion of each hull of said first and second hull portion adjacent the forward end sloping upward from an inboard side of each of the first and second hull portions to an outboard side of each of the first and second hull portions, and a horizontal deck with a raised platform extending over and between the first and second hull portions.

In accordance with further aspects of an embodiment of the invention, a catamaran hull is provided, comprising first and second hull portions extending along outboard sides of the hull, and a horizontal deck with a raised platform extending over and between the first and second hull portions, wherein the first and second hull portions and deck are unitarily formed in a single, one-piece assembly.

In accordance with still further aspects of an embodiment of the invention, a catamaran hull is provided, comprising first and second hull portions extending along outboard sides of the hull, each hull portion having a bottom surface having a forward end and a back end, and a forward portion of each hull of the first and second hull portions adjacent the forward end sloping upward from an inboard side of each of the first and second hull portions to an outboard side of each of the first and second hull portions, wherein a back portion of each hull portion immediately adjacent the back end defines an angled sloped wall along both of the inboard side and the outboard side of the first and second hull portions.

Still other aspects, features and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The numerous advantages of the present invention may be better understood by those skilled in the art by reference to the accompanying drawings in which:

FIG. 1(*b*) is a front view of the catamaran watercraft of FIG. 1(*a*).

FIG. 6(*b*) is a bottom view of the hull of FIG. 6(*a*).

FIG. 7(*b*) is a front view of the catamaran watercraft of FIG. 1(*a*) according to further aspects of an embodiment of the invention.

FIG. 7(*c*) is a back view of the catamaran watercraft of FIG. 1(*a*) according to further aspects of an embodiment of the invention.

FIG. 7(*d*) is a right side view of the catamaran watercraft of FIG. 1(*a*) according to further aspects of an embodiment of the invention.

FIG. 7(*e*) is a left side view of the catamaran watercraft of FIG. 1(*a*) according to further aspects of an embodiment of the invention.

FIG. 7(*f*) is a top view of the catamaran watercraft of FIG. 1(*a*) according to further aspects of an embodiment of the invention.

FIG. 7(*g*) is a bottom view of the catamaran watercraft of FIG. 1(*a*) according to further aspects of an embodiment of the invention.

DETAILED DESCRIPTION OF THE PREFERRED EMBODIMENTS

The invention may be understood by referring to the following description and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

Unless otherwise indicated, all dimensions shown in the attached drawings are exemplary only and should not be construed as limiting the scope of the invention to those specific dimensions.

Figure 1A:
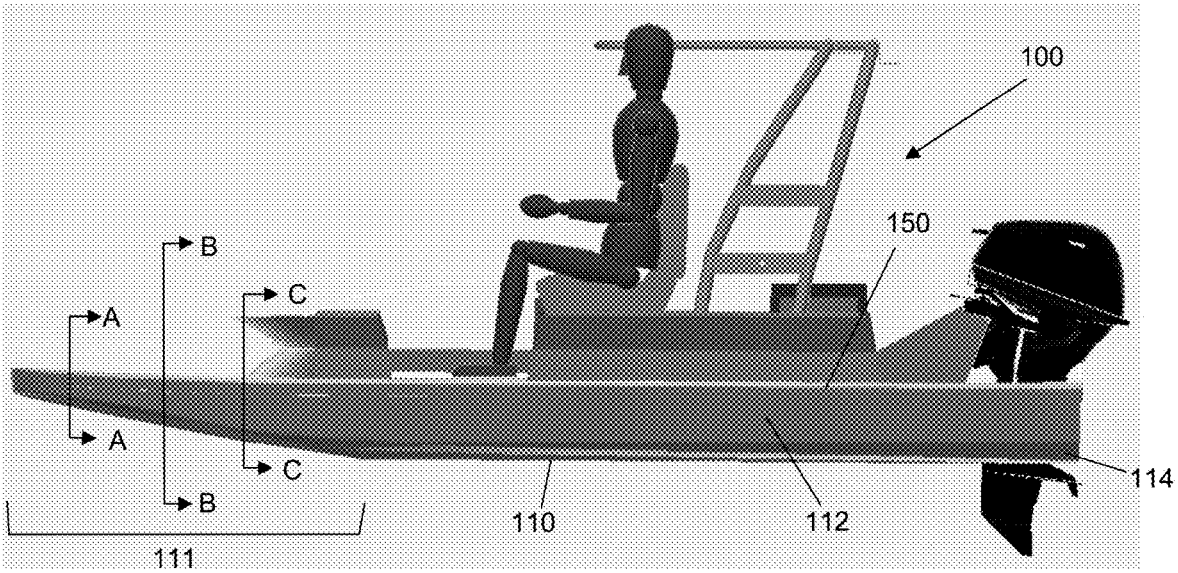
FIG. 1(*a*) is a side view of a catamaran watercraft in accordance with certain aspects of an embodiment of the invention.
Figure 1B:
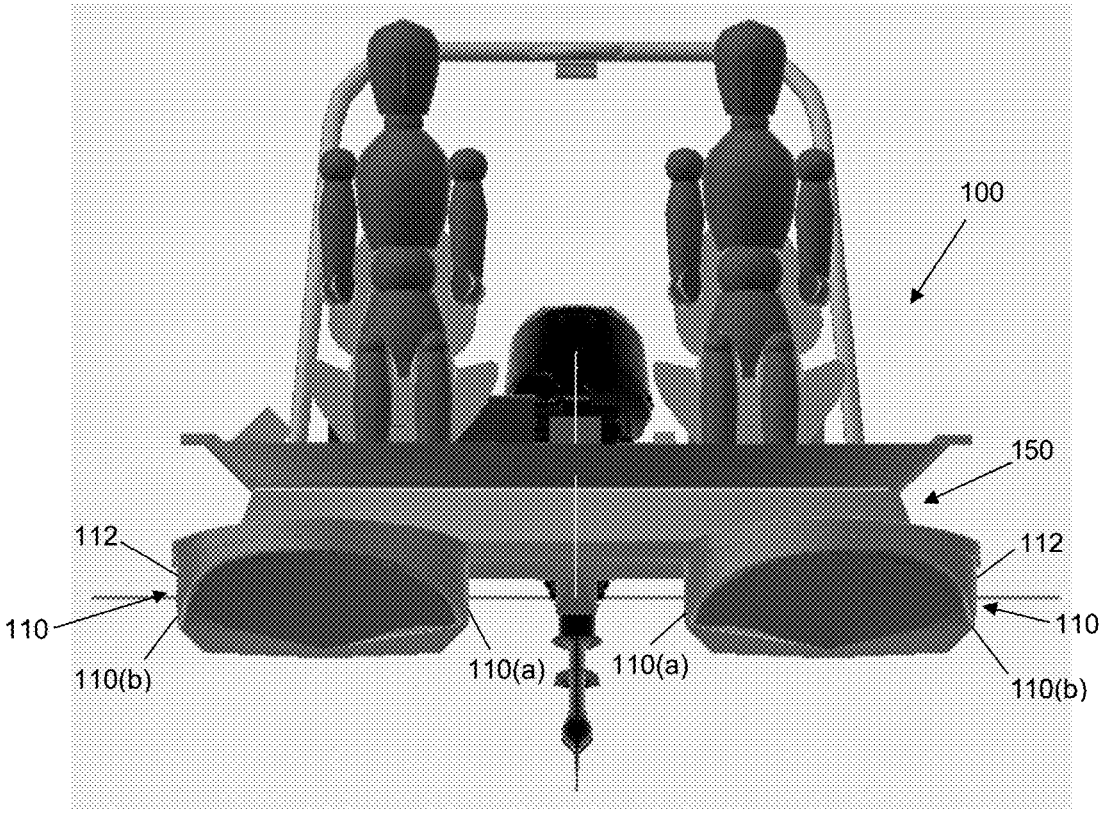

FIGS. 1(*a*) and 1(*b*) are side and front views, respectively, of a flat catamaran (shown generally at 100) in accordance with certain aspects of an embodiment of the invention. By way of summary, catamaran 100 is formed using a unibody construction method to produce two asymmetrical catamaran hulls 110 that are formed uniformly and unitarily (e.g., molded, bonded or machined as a single unit) with a deck platform 150. Each hull 110 is formed as a generally horizontal planing hull in that the sides 112 of each hull 110 have a height dimension that is significantly less that the width dimension of each hull 110, which shape allows the watercraft to run on top of the water as opposed to cutting through the water (as would be the case with a traditional V-hull configuration). Rather than comprising two identical, symmetrical hulls, each hull 110 of catamaran 100 is a mirror image of the other hull 110, wherein (as discussed in greater detail below and shown particularly in FIGS. 2(*a*)-4(*b*)) the bottom of each hull 110 in its forward portion 111 forms an inclined bottom face that angles upward from an inboard side 110(*a*) of the hull 110 to an outboard side 110(*b*) of the hull 110. With regard to certain aspects of an embodiment, the angle of incline of each inclined bottom face is less than 15°, and more preferably less than 5°, and most preferably approximately 3°. An angle of incline of 3° was particularly found to be highly beneficial when the bow of the hull 110 slaps the water, as the 3° incline was found to optimally shed water from each of hulls 110 to the outboard sides, thus keeping the passengers relatively dry.

Figure 2:
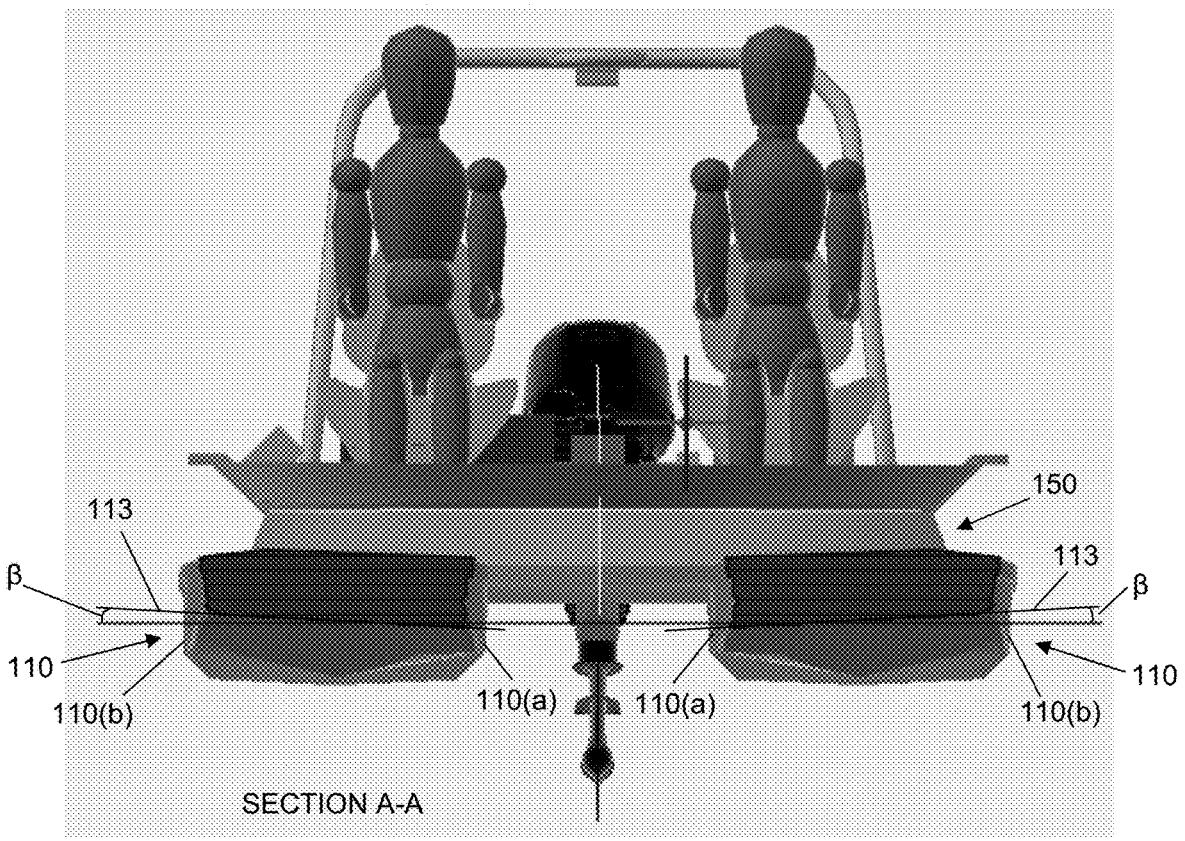
FIG. 2 is a front sectional view of the catamaran watercraft of FIG. 1(*a*) along section line A-A.
Figure 3:
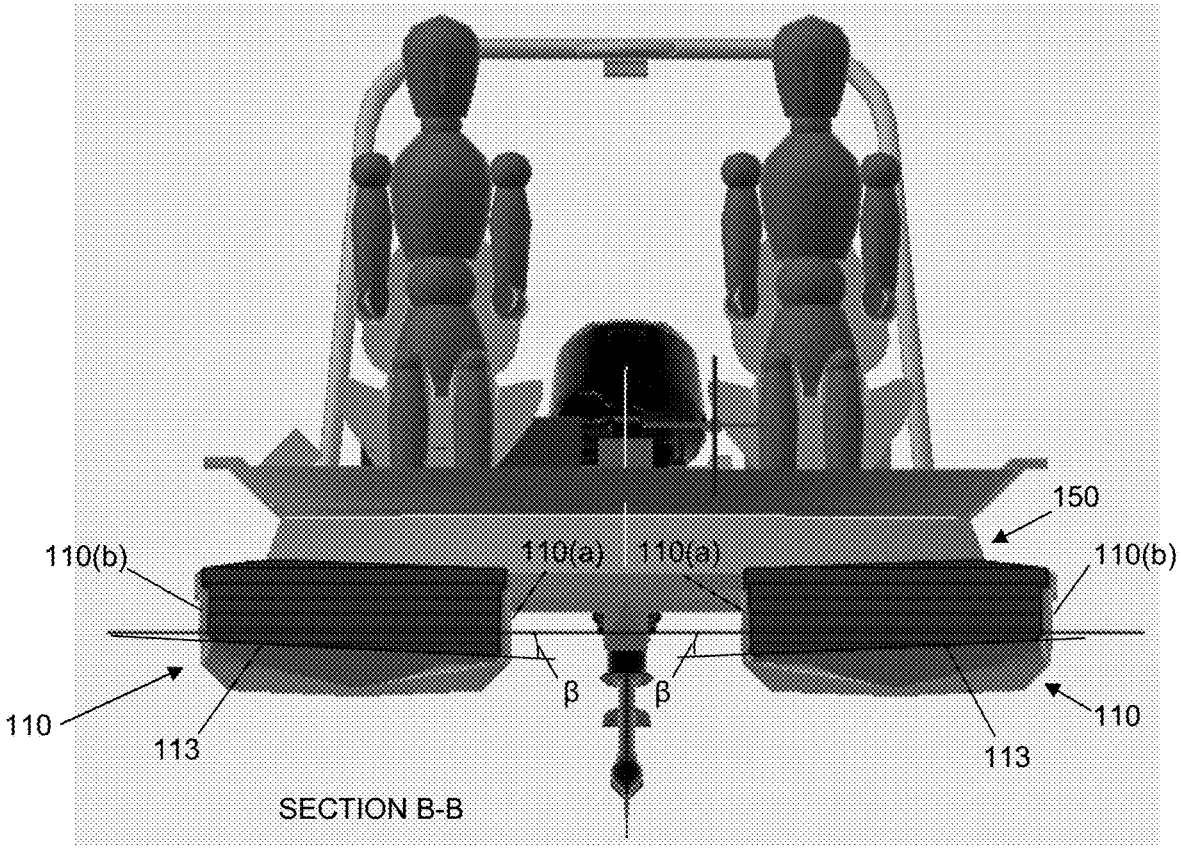
FIG. 3 is a front sectional view of the catamaran watercraft of FIG. 1(*a*) along section line B-B.
Figure 4:
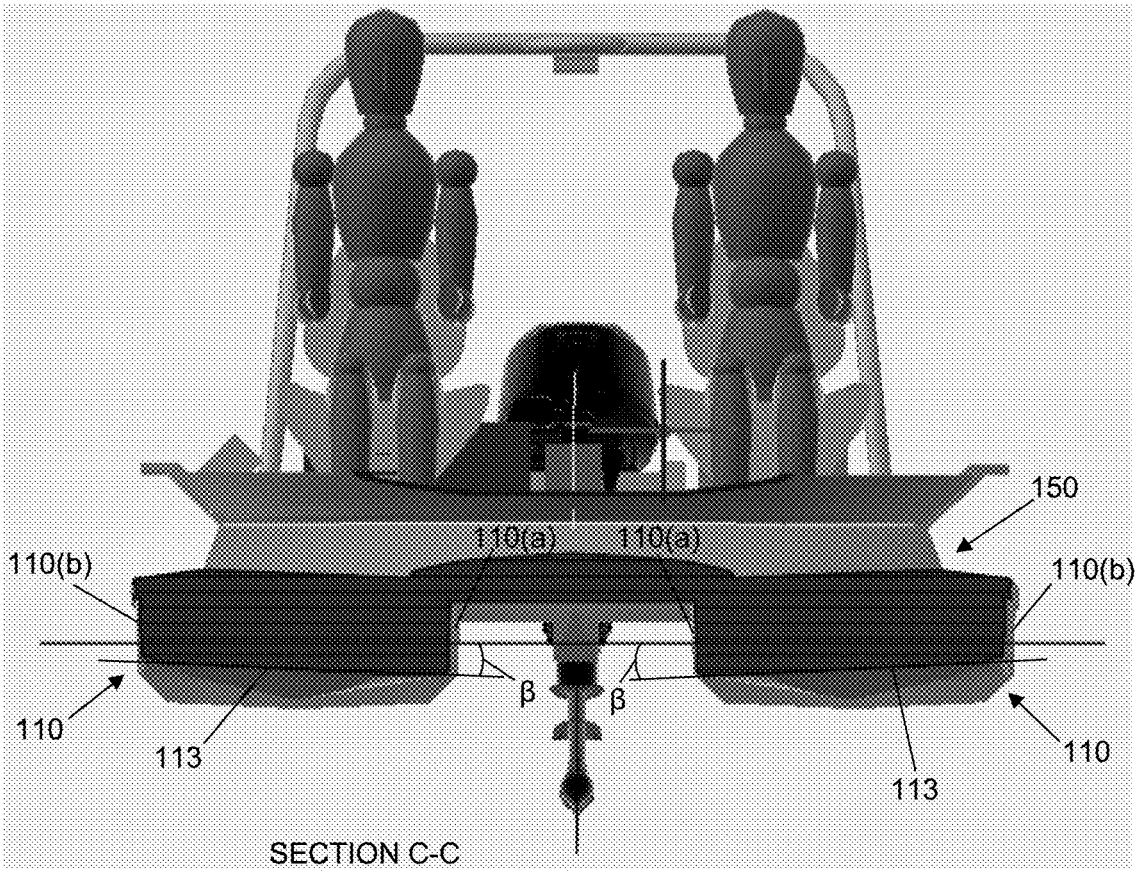
FIG. 4 is a front sectional view of the catamaran watercraft of FIG. 1(*a*) along section line C-C.

FIGS. 2-4 show side and front section views of catamaran 100 at differing points along forward portion 111 of hulls 110. Specifically, FIG. 2 shows a front section view of catamaran 100 at section A-A of FIG. 1, FIG. 3 shows a front section view of catamaran 100 at section B-B of FIG. 1, and FIG. 4 shows a front section view of catamaran 100 at section C-C of FIG. 1. As shown in each of the cross-sectional views of FIGS. 2, 3, and 4, the bottom surface of forward portion 111 of hulls 110 each define an angled face 113 that forms an angle β with respect to a horizontal plane that is parallel with the top surface of deck platform 150, such that the angled face 113 slopes upward from inboard side 110(*a*) to outboard side 110(*b*) of hulls 110. As described above, angle β is less than 15°, and more preferably less than 5°, and most preferably approximately 3°. That incline is sufficient to direct water spray toward the outboard sides of watercraft 100 as it travels through the water, thus directing water splash and spray away from passengers seated on watercraft 100.

Figure 5:
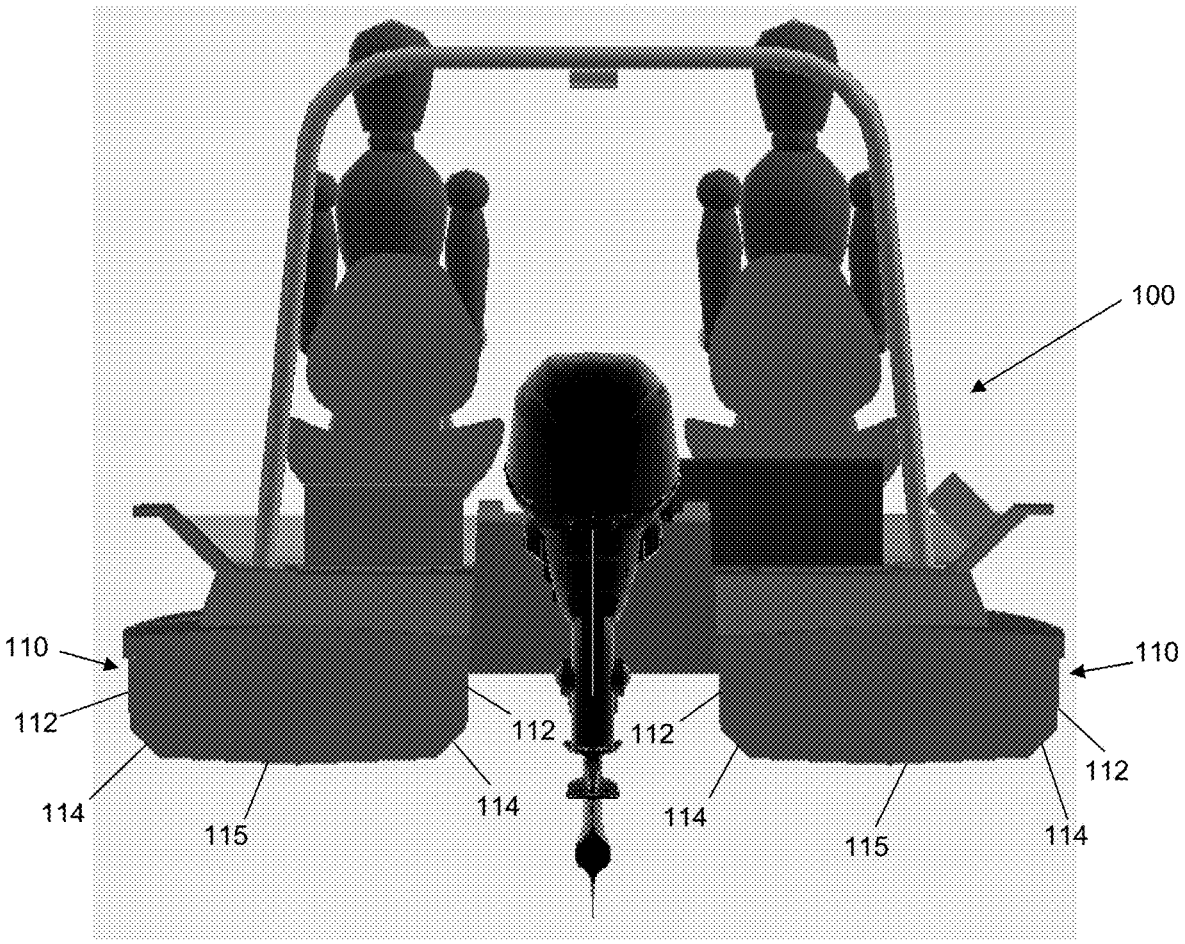
FIG. 5 is a back view of the catamaran watercraft of FIG. 1(*a*).

Further, and as best viewed in the rear view of catamaran 100 of FIG. 5, each hull 110 of catamaran 100 likewise has an angled face 114 between both inboard and outboard sidewalls 112 and bottom surface 115, which bottom surface 115 has a generally flat contour. Angled face 114 is preferably situated at an angle of between 30° and 60°, more preferably between 40° and 50°, and most preferably is situated at an angle of approximately 45°, with angled face 114 extending from the back of each hull 110 toward the front of watercraft 100. Differing from typical catamaran or other watercraft hulls, angled face 114 on each bottom side of each of hulls 110 serve to allow watercraft 100 to drift or slide along the surface of the water during a turn, similar to the movement of an airboat across the surface of the water.

Figure 6A:
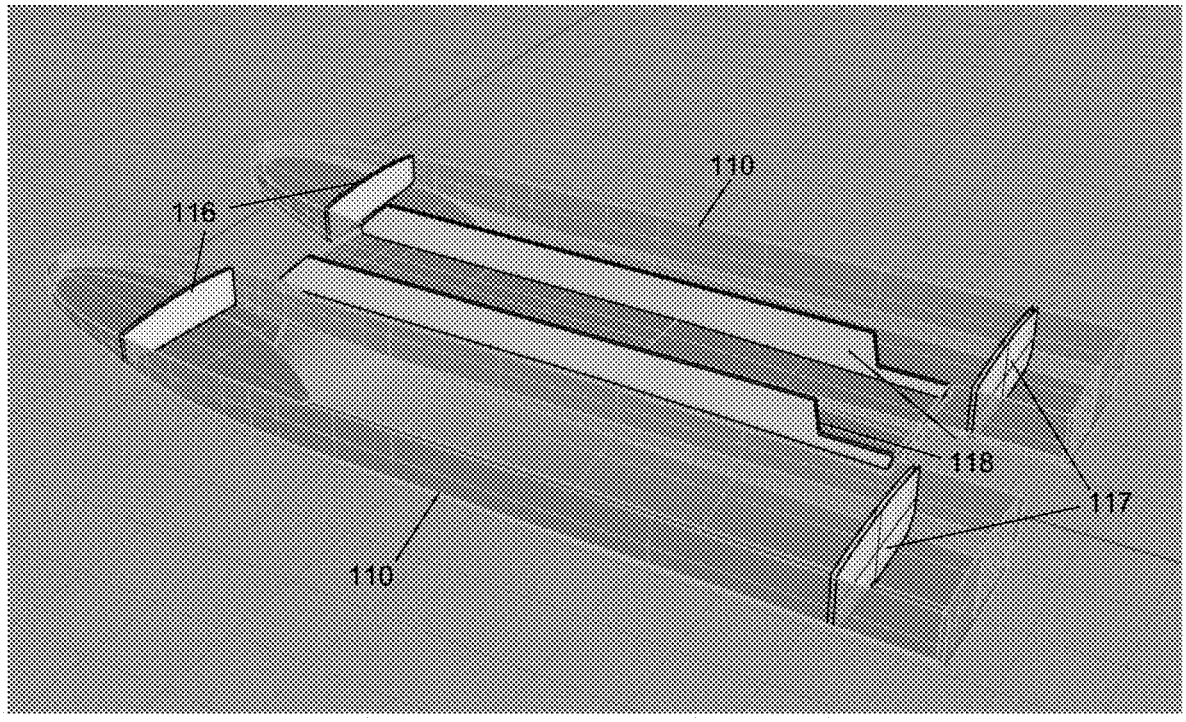
FIG. 6(*a*) is a perspective sectional view of a hull for use with the catamaran watercraft of FIG. 1(*a*) showing a plurality of internal bulkheads inside of the hull.
Figure 6B:
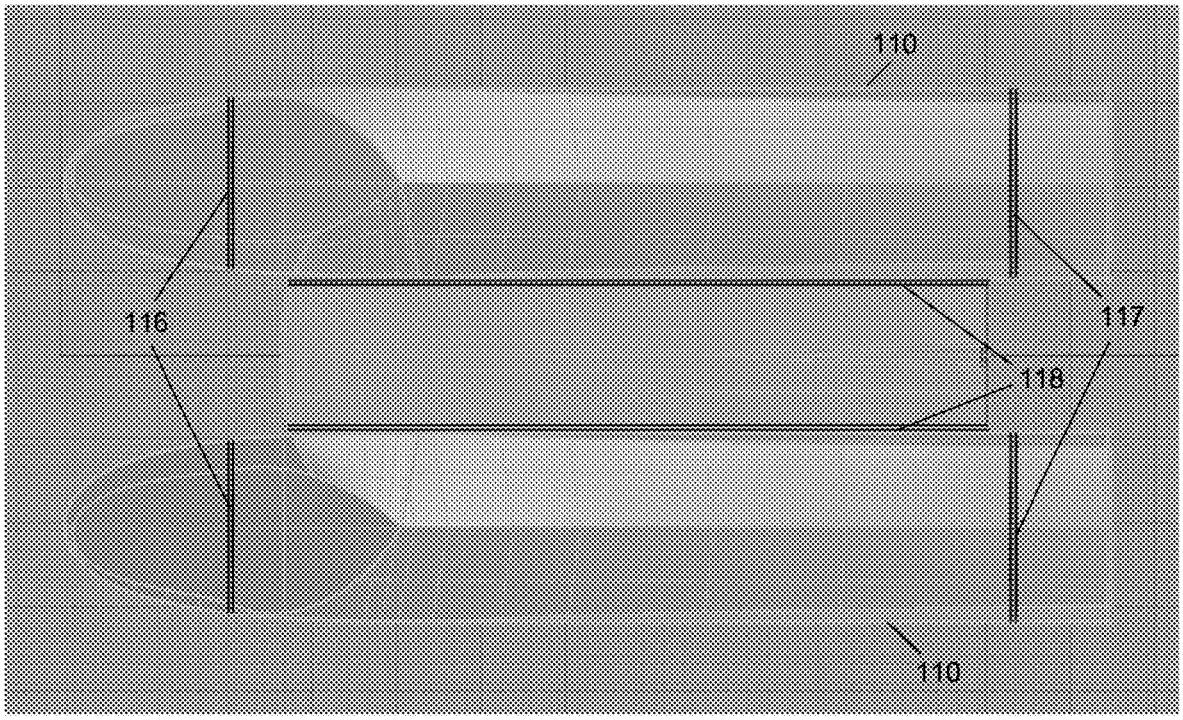
Figure 7A:
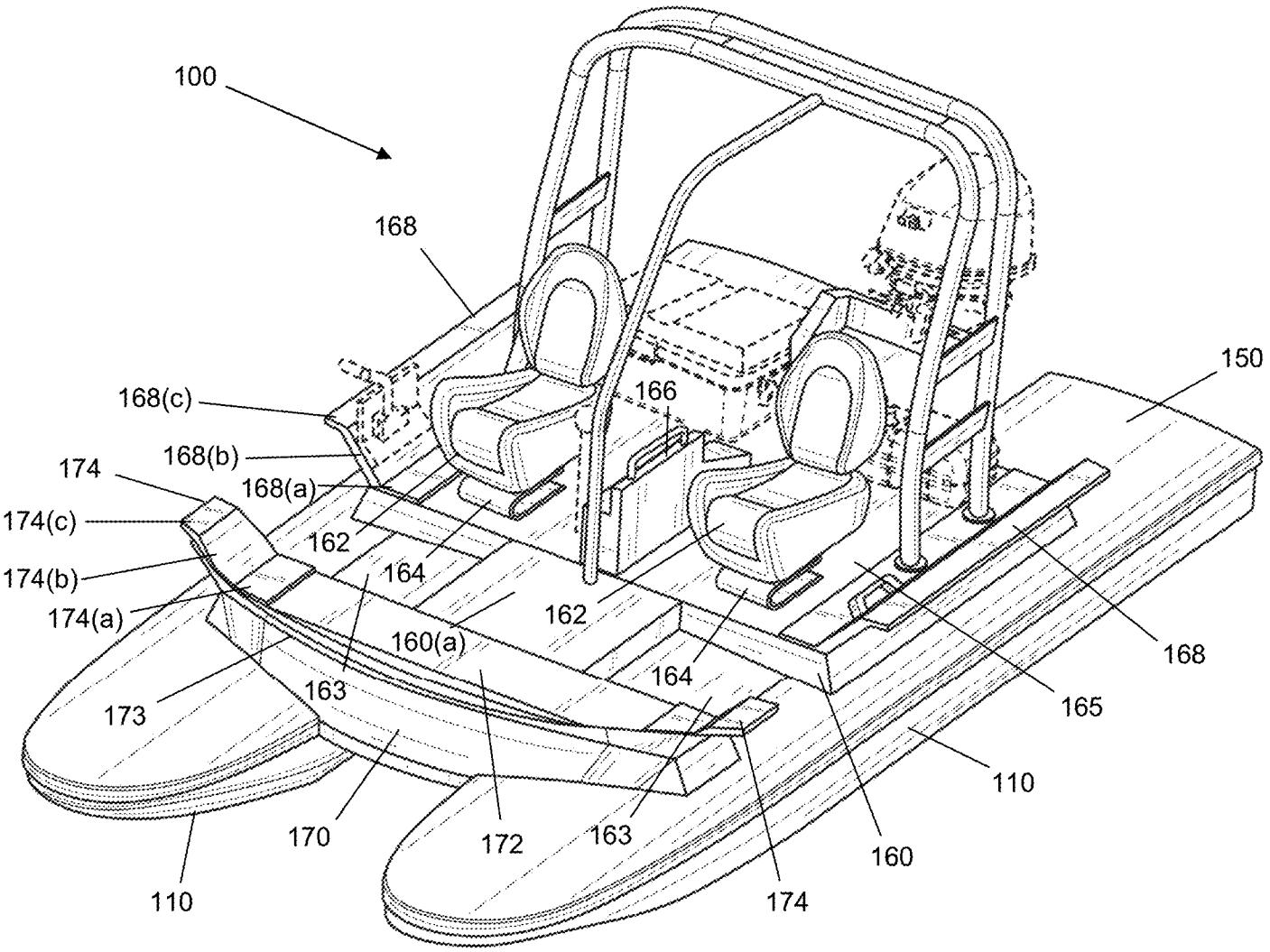
FIG. 7(*a*) is a perspective view of the catamaran watercraft of FIG. 1(*a*) according to further aspects of an embodiment of the invention.
Figure 7B:
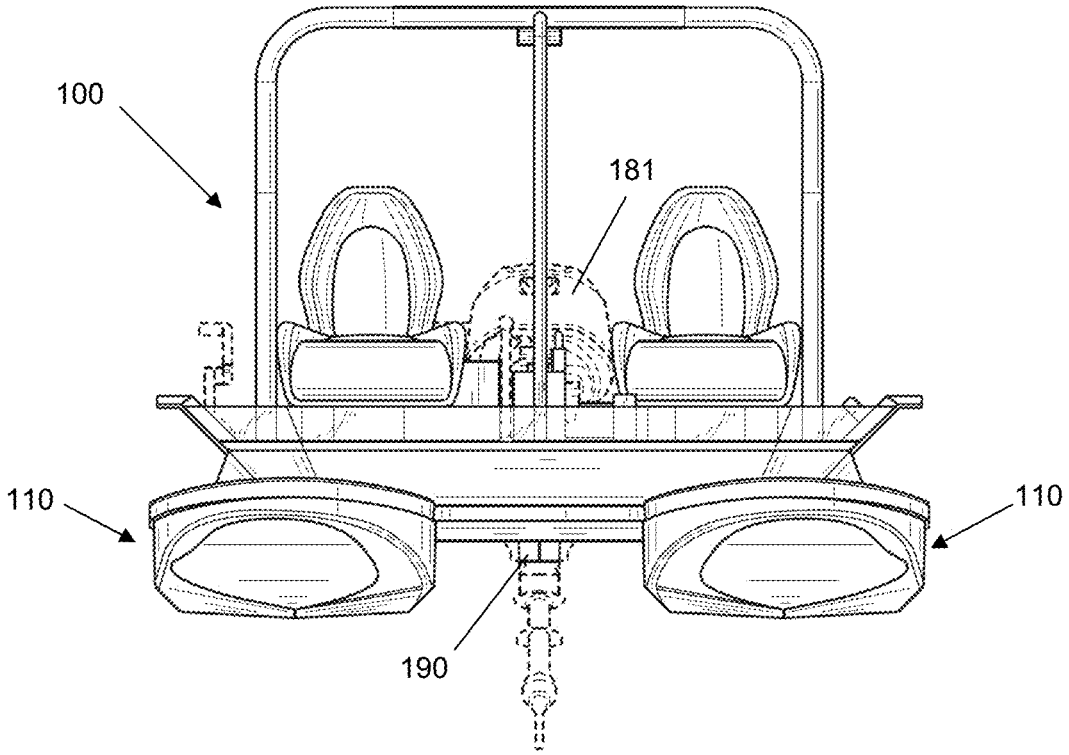
Figure 7C:
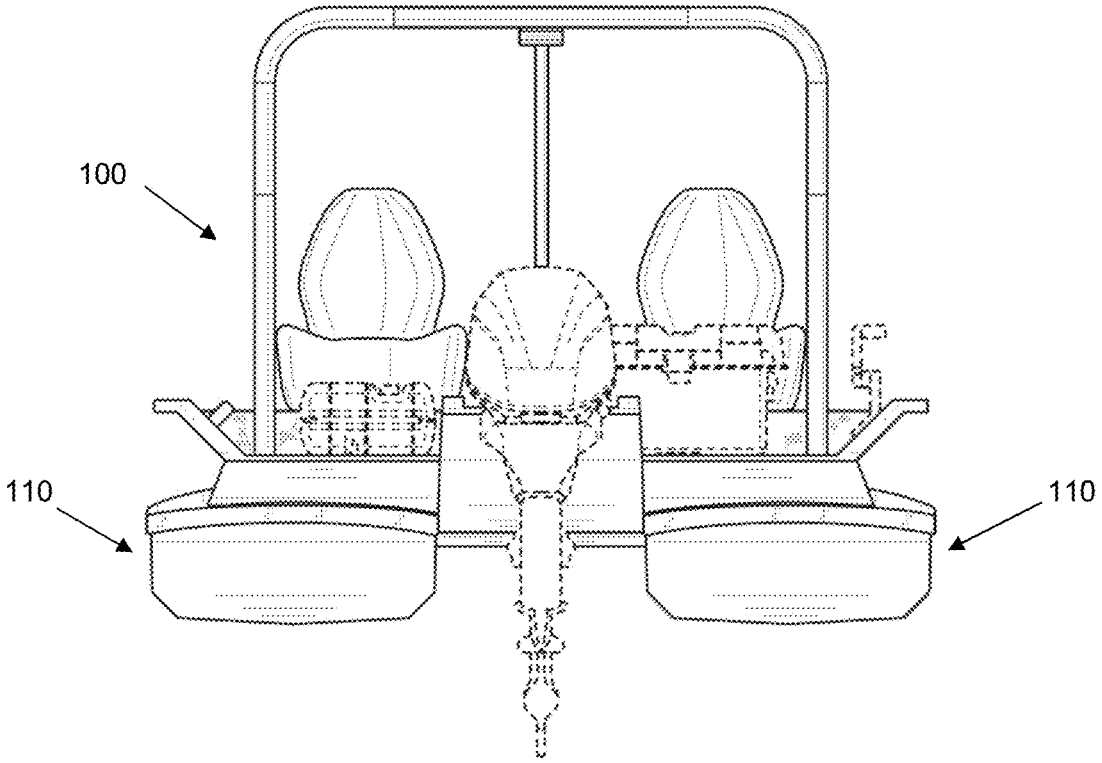
Figure 7D:
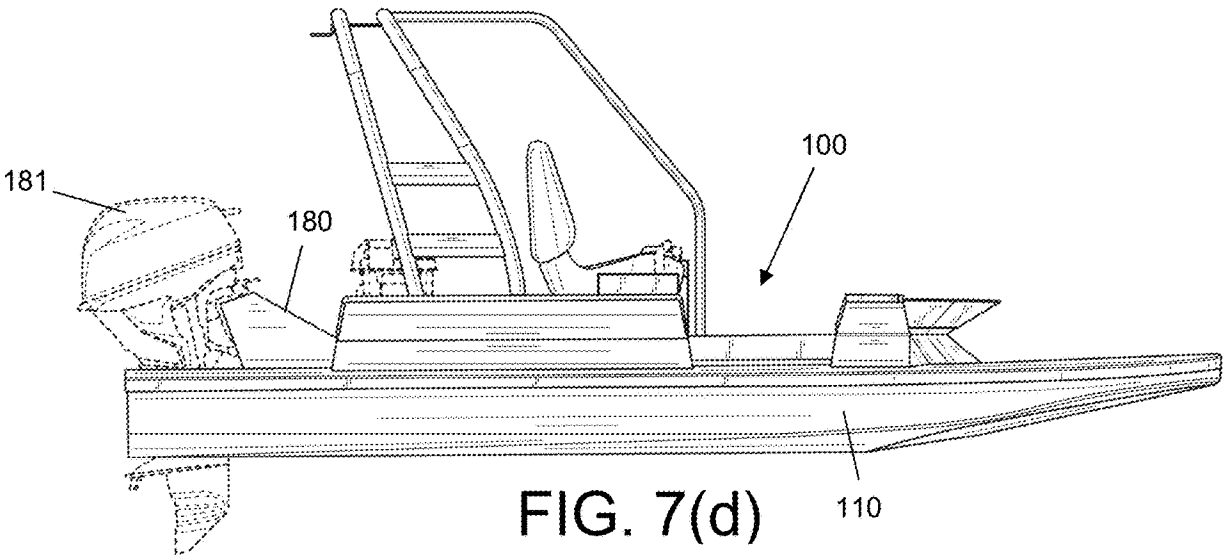
Figure 7E:
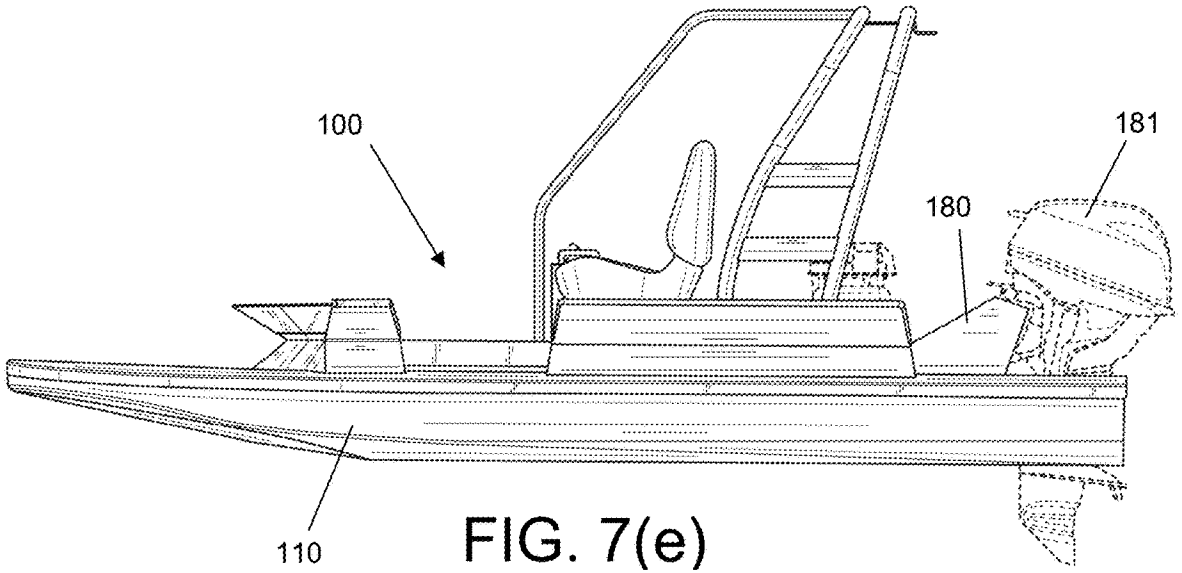
Figure 7F:
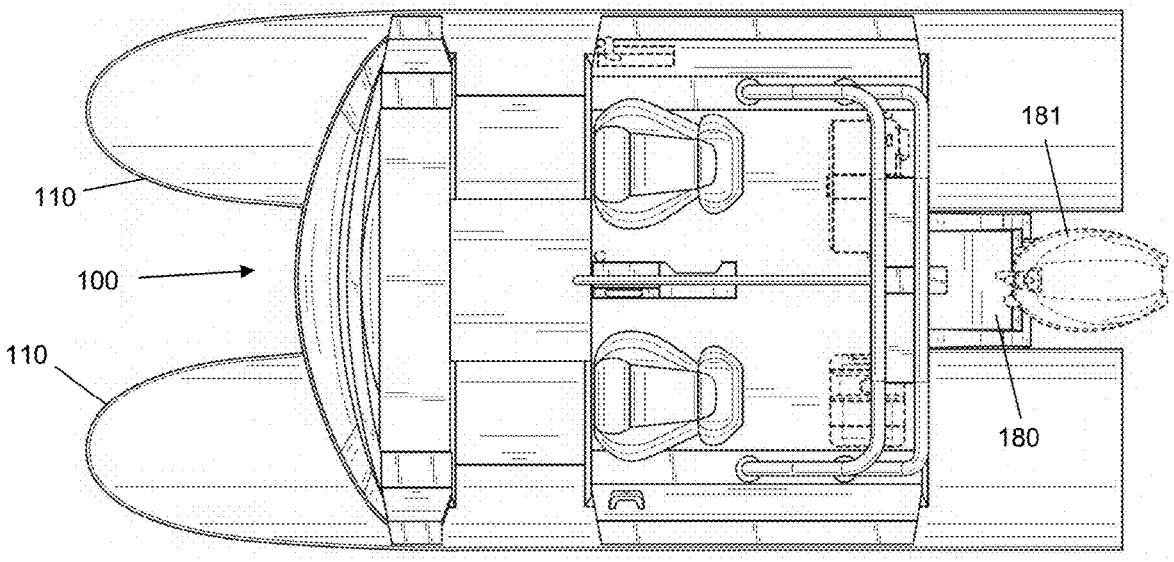
Figure 7G:
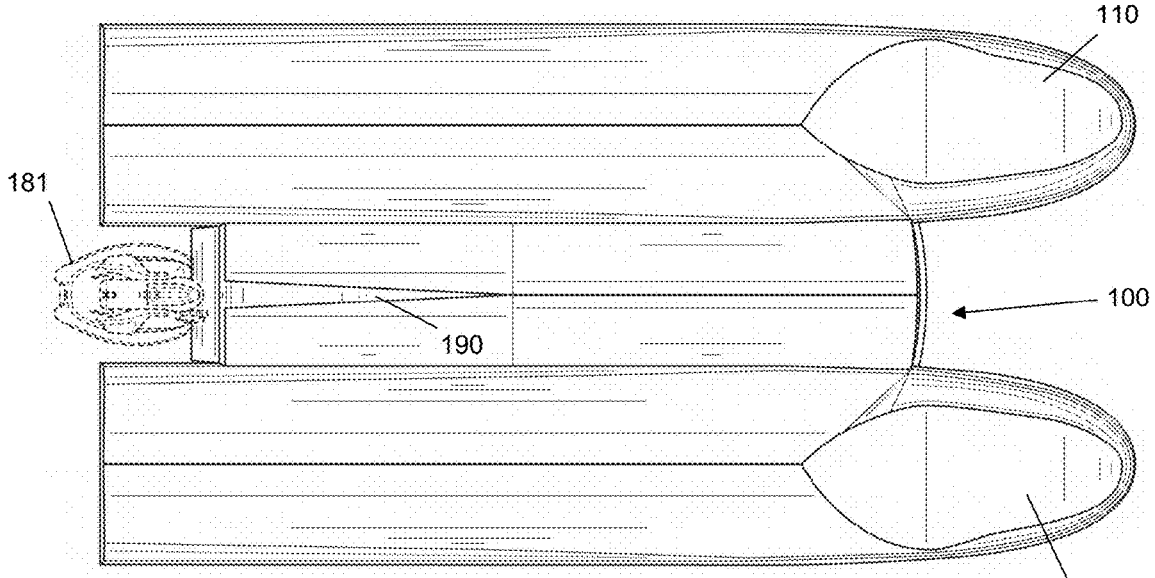

FIGS. 6(*a*) and 6(*b*) show perspective and top cross-sectional views, respectively, of a bottom-most portion of watercraft 100 below deck platform 150. As shown in FIGS. 6(*a*) and 6(*b*), an interior of the hull assembly is preferably fitted with front catamaran hull athwartship crash bulkheads 116, back catamaran hull athwartship bulkheads 117, and center longitudinal bulkheads 118, each of which is once again preferably formed unitarily with the rest of the hull construction, such as by molding, bonding, or machining as a single unit. Bulkheads 116 and 118 thus form water-tight chambers, and more particularly five independent watertight chambers, including two chambers forward of the crash bulkheads 116, two aft of the crash bulkheads 116 in each of catamaran hulls 110, and one chamber in the center portion between the two longitudinal bulkheads 118, which separate the catamaran hulls 110. Providing five independent water-tight chambers adds to the overall safety and flotation of the watercraft 100 in comparison to previously known constructions.

FIGS. 7(*a*)-7(*g*) are various views of watercraft 100 according to a particularly preferred embodiment of the invention. As shown in FIGS. 7(*a*)-7(*g*), watercraft 100 is formed with a unibody construction, whereby flat catamaran hulls 110, deck platform 150, seating portion 160 positioned above deck platform 150, and platform bow section 170 are all formed of a unitary construction, such as molded, bonded or machined as a single unit, providing a significantly more stable platform that offers passengers an improved and more stable riding experience over previously known constructions. Mounted on seating portion 160 are seats 162. More particularly, shock absorbing seat mounts 164 formed of an aluminum spring loaded mounting bracket are mounted to the top face 165 of seating portion 160, and passenger/operator seats 162 are in turn mounted to the top of each shock absorbing seat mount 164. A waterproof console 166 is positioned between the two seats 162 and is similarly mounted to the top face 165 of seating portion 160, which waterproof console 166 prevents saltwater and other contaminants from reaching the steering mechanism and sensitive electronics contained within the console 166. Along each side edge of seating portion 160, gull wing panels 168 are mounted to top face 165 of seating portion 160. Each gull wing panel 168 includes a flat lower panel 168(*a*) that joins each gull wing panel 168 to the top face 165 of seating portion 160, an angled face 168(*b*) that extends both outward and upward towards the sides of the watercraft 100, and a flat upper panel 168(*c*) forming a walkway along the side of watercraft 100. Flat upper panel 168(*c*) is preferably provided with a non-slip surface of known configuration that provides a safe grip underfoot for persons walking along flat upper panel 168(*c*) from the front to the rear of the watercraft, and vice versa.

Platform bow section 170 (which again is formed unitarily with flat catamaran hulls 110, deck platform 150, and seating portion 160) has a top face 172 that similarly mounts forward gull wing panels 174. As with gull wing panels 168, forward gull wing panels 174 each include a flat lower panel 174(*a*) that joins each forward gull wing panel 174 to the top face 172 of platform bow section 170, an angled face 174(*b*) that extends outward towards the sides of the watercraft 100, and a flat upper panel 174(*c*) that may similarly serve as a stepping surface for an operator or passenger to move to the forward-most portions of catamaran hulls 110. A preferably one-piece splash shield 173 may be provided and affixed to the front of each forward gull wing panel 174 to further aid in preventing splash and spray from contacting the operator and passenger when the watercraft 100 is underway.

The rear of platform section 150 also includes a motor mount 180 which again is part of the unibody construction that includes catamaran hulls 110 and platform section 150. As best shown in FIGS. 7(*d*) and 7(*e*), motor mount 180 receives motor 181 and, as a result of the unibody construction discussed above, provides improved structural support for motor 181.

With reference again to FIG. 7(*a*), footwells 163 are formed in front of each seat 162. More particularly, each footwell 163 has a floor formed by deck platform 150, a back wall formed by seating portion 160, a front wall formed by platform bow section 170, and in interior wall formed by seating portion extension 160(*a*) that extends between seating portion 160 and platform bow section 170. In this configuration, each footwell 163 is positioned with respect to each seat 162 to provide proper seating height to reduce knee strain and fatigue, and provides positive foot support when maneuvering the watercraft 100 through turns. Further, as each footwell 163 is molded in and enclosed on three sides, they each help to further block water from hitting the watercraft passengers when underway, thus improving the overall comfort of the passengers, and improving upon previous constructions that have included open footwells or poorly sealed footwells.

Further, and as best shown on FIGS. 7(*b*) and 7(*g*), the bottom of the unibody construction of watercraft 100 preferably includes a generally triangular skeg 190 positioned in the rear center of the bottom of the tunnel between the hulls, which skeg tapers as it extends towards the front of watercraft 100. Skeg 190 helps to smooth out water turbulence prior to the flow of water reaching motor 181.

A watercraft configured in accordance with the foregoing and that particularly embodies an upward slope of the bottom of each flat catamaran hull may shed water and waves to the outboard sides of the vessel as it travels through the water to a greater extent than previously known catamaran constructions. Likewise, a watercraft configured in accordance with the foregoing and that particularly provides the rear portions of each such hull with an angled slope along both inboard and outboard sides of the hull may allow the rear portion of the watercraft to slide and drift sideways along the surface of the water as the watercraft turns, thus adding an element of excitement to the movement of the watercraft over previously known constructions. Still further, a watercraft configured in accordance with the foregoing and particularly embodying a unibody construction may ease manufacture and provide a more rigid, stable and robust platform than previously known constructions.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A flat catamaran hull, comprising:

a first hull portion and a second hull portion extending along outboard sides of the hull, each of said first hull portion and said second hull portion having a bottom surface having a forward end and a back end, and a forward portion of each of said first hull portion and said second hull portion adjacent said forward end sloping upward from an inboard side of each of said first hull portion and said second hull portion to an outboard side of each of said first hull portion and said second hull portion;

a horizontal deck with a raised platform extending over and between said first hull portion and said second hull portion; and a triangular skeg on a bottom side of a tunnel between the first hull portion and the second hull portion and positioned adjacent to the back end of the hull.

2. The flat catamaran hull of claim 1, wherein a slope of each of said forward portions exhibits an incline angle of less than 15° from a horizontal plane parallel to the horizontal deck.

3. The flat catamaran hull of claim 2, wherein said incline angle is less than 5° from said horizontal plane.

4. The flat catamaran hull of claim 3, wherein said incline angle is 3° from said horizontal plane.

5. The flat catamaran hull of claim 1, wherein a back portion of each of said first hull portion and said second hull portion immediately adjacent said back end defines an outwardly angled face portion extending forward from said back end between the bottom surface of each of said first hull portion and said second hull portion and each of an outboard sidewall and an inboard sidewall of each of said first hull portion and said second hull portion, respectively.

6. The flat catamaran hull of claim 1, wherein the first hull portion and the second hull portion are asymmetrical to one another.

7. The flat catamaran hull of claim 1, wherein said first hull portion and said second hull portion and deck are unitarily formed in a single, one-piece assembly.

8. The flat catamaran hull of claim 1, further comprising a plurality of water-tight bulkheads on an interior of the hull in each of said first hull portion and said second hull portion and extending from an interior side of each of said first hull portion and said second hull portion to an interior side of the horizontal deck.

9. The flat catamaran hull of claim 8, said water-tight bulkheads forming multiple, independent watertight chambers inside of the hull.

10. The flat catamaran hull of claim 1, further comprising a seating portion formed unitarily with and positioned on a top side of the horizontal deck, said seating portion mounting one or more seats.

11. The catamaran hull of claim 10, further comprising footwells formed unitarily with said horizontal deck and said seating portion and positioned in front of each said seat.

12. The catamaran hull of claim 11, wherein each said footwell is defined by a floor formed by said horizontal deck, a back wall formed by said seating portion, a front wall formed by a platform bow section extending between the first and second hull portions, and an interior side wall.

13. The flat catamaran hull of claim 10, further comprising a U-shaped spring loaded mounting bracket mounting said seat above said seating portion.

14. The flat catamaran hull of claim 10, further comprising a waterproof catamaran control console formed unitarily with and positioned on a top side of the seating portion adjacent one of said one or more seats, said control console mounting one or more catamaran controls.

15. The flat catamaran hull of claim 10, further comprising at least one gull wing panel mounted to a top face of the seating portion and extending adjacent a side edge of the catamaran hull.

16. The flat catamaran hull of claim 15, said gull wing panel further comprising a flat lower portion mounted to the top side of the seating portion, an angled face extending upward and outward from the flat lower portion, and a flat top portion extending outward from the angled face and forming a walkway extending adjacent the side edge of the catamaran hull.

17. The flat catamaran hull of claim 1, further comprising a bow portion formed unitarily with and positioned on a top side of the horizontal deck and extending between the first and second hull portions.

18. The flat catamaran hull of claim 17, further comprising at least one gull wing panel mounted to a top face of the bow portion.

19. The flat catamaran hull of claim 18, said gull wing panel further comprising a flat lower portion mounted to the top face of the bow portion, an angled face extending upward and outward from said flat lower portion, and a flat top portion extending outward from the angled face and forming a stepping surface adjacent the side edge of the catamaran hull.

20. The flat catamaran hull of claim 18, further comprising a splash shield affixed to the front of each gull wing panel and extending along a top width of the bow portion.

21. The flat catamaran hull of claim 1, further comprising a motor mount formed unitarily with and positioned on a top side of the horizontal deck adjacent to the back end of the hull.

22. The flat catamaran hull of claim 1, said triangular skeg tapering along a length of the skeg from a rear portion of the skeg to a front portion of the skeg.

23. A catamaran hull, comprising:

a first hull portion and a second hull portion each extending along outboard sides of the hull, each of said first hull portion and said second hull portion having a bottom surface having a forward end and a back end, an outboard sidewall, and an inboard sidewall; and a horizontal deck with a raised platform extending over and between said first hull portion and said second hull portion;

wherein said first hull portion and said second hull portion and deck are unitarily formed in a single, one-piece assembly; and wherein a forward portion of a bottom of said first hull portion and a forward portion of a bottom of said second hull portion each defines a flat, planar angled face that forms an angle with respect to a horizontal plane that is parallel with the top surface of the horizontal deck, such that the flat, planar angled face slopes upward from the inboard side of each of said first hull portion and said second hull portion to an outboard side of each of said first hull portion and said second hull portion and extends upward to a front edge of each of said first hull portion and said second hull portion; and an outwardly angled face portion extending forward from said back end between the bottom surface of each of said first hull portion and said second hull portion and each said outboard sidewall and said inboard sidewall of each of said first hull portion and said second hull portion, respectively.

24. The catamaran hull of claim 23, further comprising a plurality of water-tight bulkheads on an interior of the hull in each of said first and second hull portions and extending from an interior side of each of said first and second hull portion to an interior underside of the horizontal deck.

25. The catamaran hull of claim 24, said water-tight bulkheads forming multiple, independent watertight chambers inside of the hull.

26. A catamaran hull, comprising:

a first hull portion and a second hull portion each extending along outboard sides of the hull, each of said first hull portion and said second hull portion having a bottom surface having a forward end and a back end, an outboard sidewall, and an inboard sidewall;

a horizontal deck extending over and between said first and second hull portions, wherein a forward portion of the bottom of said first hull portion and a forward portion of the bottom of said second hull portion each defines a flat, planar angled face that forms an angle with respect to a horizontal plane that is parallel with the top surface of the horizontal deck, such that the flat, planar angled face slopes upward from an inboard side of each of said first hull portion and said second hull portion to an outboard side of each of said first hull portion and said second hull portion and extends upward to a front edge of each of said first hull portion and said second hull portion; and an outwardly angled face portion extending forward from said back end between the bottom surface of each of said first hull portion and said second hull portion and each said outboard sidewall and said inboard sidewall of each of said first hull portion and said second hull portion, respectively.

* * * * *